US010286672B2

(12) United States Patent
Yoshiike

(10) Patent No.: US 10,286,672 B2
(45) Date of Patent: May 14, 2019

(54) LIQUID DISCHARGE HEAD, LIQUID DISCHARGE DEVICE, LIQUID SUPPLY MEMBER, AND LIQUID DISCHARGE APPARATUS

(71) Applicant: Masataka Yoshiike, Kanagawa (JP)

(72) Inventor: Masataka Yoshiike, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/787,226

(22) Filed: Oct. 18, 2017

(65) Prior Publication Data

US 2018/0141343 A1 May 24, 2018

(30) Foreign Application Priority Data

Nov. 18, 2016 (JP) ..... 2016-225482
Sep. 1, 2017 (JP) ..... 201 7-1 681 84

(51) Int. Cl.
*B41J 2/175* (2006.01)
*B41J 2/14* (2006.01)
*B41J 2/145* (2006.01)

(52) U.S. Cl.
CPC ..... *B41J 2/17523* (2013.01); *B41J 2/145* (2013.01); *B41J 2/14233* (2013.01);
(Continued)

(58) Field of Classification Search
CPC ..... B41J 2/055
See application file for complete search history.

(56) References Cited

U.S. PATENT DOCUMENTS

2007/0064048 A1* 3/2007 Lee ..... B41J 2/155 347/40
2009/0102899 A1* 4/2009 Rutten ..... B41J 2/055 347/85

(Continued)

FOREIGN PATENT DOCUMENTS

JP 2013-154556 8/2013
JP 2014-030939 2/2014

(Continued)

OTHER PUBLICATIONS

U.S. Appl. No. 15/607,923, filed May 30, 2017, Masataka Yoshiike.

*Primary Examiner* — Shelby L Fidler
(74) *Attorney, Agent, or Firm* — Oblon, McClelland, Maier & Neustadt, L.L.P.

(57) ABSTRACT

A liquid discharge head includes a plurality of nozzles to discharge liquid, a plurality of individual liquid chambers communicating with the plurality of nozzles, respectively, a common liquid chamber to supply the liquid to the plurality of individual liquid chambers, and a liquid supply member including a liquid supply channel to supply the liquid to the common liquid chamber. The liquid supply member includes a first member including a part of the liquid supply channel, a second member including a gas chamber, and an elastic member disposed between the first member and the second member and forming a wall of the liquid supply channel of the first member and a wall of the gas chamber of the second member. The gas chamber of the second member is disposed opposite the liquid supply channel of the first member via the elastic member.

13 Claims, 14 Drawing Sheets

(52) U.S. Cl.
CPC ..... *B41J 2/1752* (2013.01); *B41J 2/17509* (2013.01); *B41J 2002/14241* (2013.01); *B41J 2002/14362* (2013.01); *B41J 2002/14491* (2013.01)

(56) References Cited

U.S. PATENT DOCUMENTS

| | | | | |
|---|---|---|---|---|
| 2009/0244228 | A1* | 10/2009 | Hibi | B41J 2/055 347/94 |
| 2012/0007909 | A1* | 1/2012 | Zhang | B41J 2/055 347/17 |
| 2012/0236082 | A1* | 9/2012 | Akahane | B41J 2/14274 347/68 |
| 2013/0182040 | A1 | 7/2013 | Kinokuni et al. | |
| 2014/0036007 | A1 | 2/2014 | Sasaki | |
| 2015/0375505 | A1 | 12/2015 | Takahashi | |
| 2016/0096386 | A1 | 4/2016 | Yoshiike | |
| 2017/0066266 | A1 | 3/2017 | Yoshiike | |
| 2017/0100935 | A1 | 4/2017 | Yoshiike | |
| 2017/0151782 | A1 | 6/2017 | Takahashi et al. | |

FOREIGN PATENT DOCUMENTS

| | | |
|---|---|---|
| JP | 2015-107633 | 6/2015 |
| JP | 2016-016638 | 2/2016 |

* cited by examiner

LIQUID DISCHARGE HEAD, LIQUID DISCHARGE DEVICE, LIQUID SUPPLY MEMBER, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2016-225482, filed on Nov. 18, 2016 in the Japan Patent Office and Japanese Patent Application No. 2017-168184, filed on Sep. 1, 2017 in the Japan Patent Office, the entire disclosures of which are hereby incorporated by reference herein.

BACKGROUND

Technical Field

Aspects of this disclosure relate to a liquid discharge head, a liquid discharge device, a liquid supply member, and a liquid discharge apparatus.

Related Art

A liquid discharge head includes a liquid supply member having a liquid supply channel for supplying liquid to a common liquid chamber of a head main body of the liquid discharge head.

For example, the liquid discharge head includes the liquid supply channel interposed between an ink tank and the head main body of the liquid discharge head. The liquid supply member is formed by connecting an upper part of a connection channel and a lower part of the connection channel via an elastic member (sheet gasket). The elastic member forms a wall of a portion of the liquid supply channel formed along a nozzle face.

SUMMARY

In an aspect of this disclosure, a novel liquid discharge head includes a plurality of nozzles to discharge liquid, a plurality of individual liquid chambers communicating with the plurality of nozzles, respectively, a common liquid chamber to supply the liquid to the plurality of individual liquid chambers, and a liquid supply member including a liquid supply channel to supply the liquid to the common liquid chamber. The liquid supply member includes a first member including a part of the liquid supply channel, a second member including a gas chamber, and an elastic member disposed between the first member and the second member and forming a wall of the liquid supply channel of the first member and a wall of the gas chamber of the second member. The gas chamber of the second member is disposed opposite the liquid supply channel of the first member via the elastic member.

In another aspect of this disclosure, a liquid discharge head includes a common-chamber member including a common liquid chamber to supply liquid to a plurality of individual liquid chambers communicating respectively with a plurality of nozzles, from which the liquid is discharged, a liquid supply member including a liquid supply channel to supply the liquid to the common liquid chamber, and an elastic member disposed between the common-chamber member and the liquid supply member and forming a wall of the common liquid chamber. The liquid supply member includes a gas chamber disposed opposite the common liquid chamber via the elastic member.

In still another aspect of this disclosure, a liquid supply member includes a liquid supply channel connected to a common liquid chamber formed in a liquid discharge head that includes a plurality of nozzles to discharge liquid. The liquid supply member includes a first member including a part of the liquid supply channel, and a second member including a gas chamber. An elastic member is disposed between the first member and the second member, the elastic member forming a wall of the liquid supply channel of the first member and a wall of the gas chamber of the second member. The gas chamber of the second member is disposed opposite the liquid supply channel of the first member via the elastic member.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
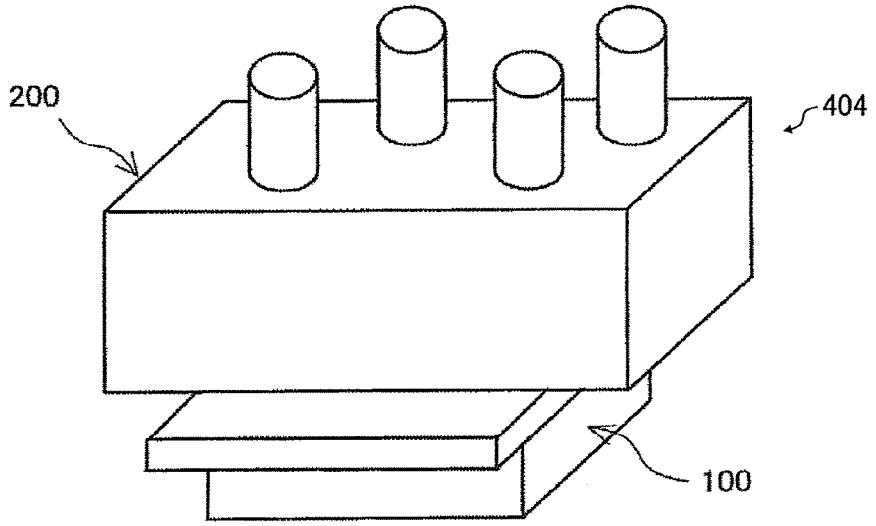
FIG. 1 is a perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

Below, embodiments of the present disclosure are described with reference to the attached drawings.

Figure 2:
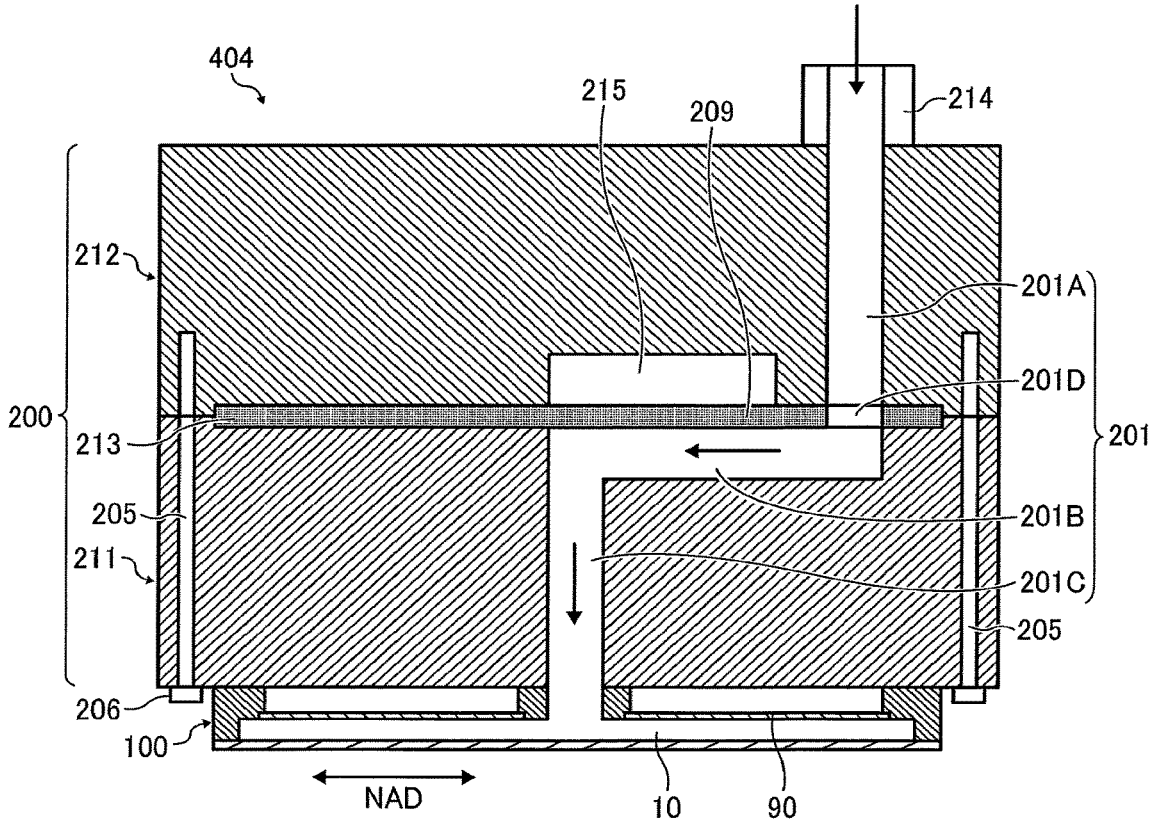
FIG. 2 is a cross-sectional view of the liquid discharge head along a direction along a nozzle array direction (longitudinal direction of common liquid chamber)
Figure 3:
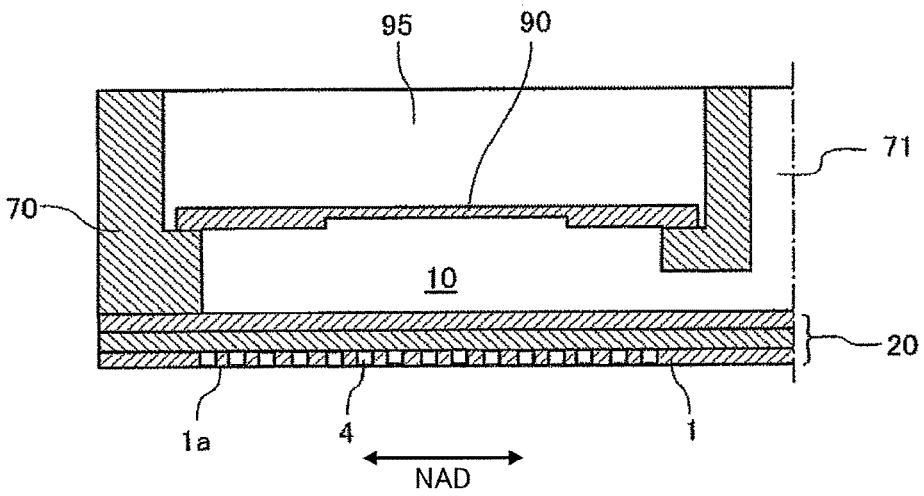
FIG. 3 is an enlarged cross-sectional view of a head main body of the liquid discharge head.

FIGS. 1 to 3 illustrate a liquid discharge head 404 according to a first embodiment of the present disclosure.

FIG. 1 is a perspective view of the liquid discharge head 404 according to the first embodiment of the present disclosure.

FIG. 2 is a cross-sectional view of the liquid discharge head 404 of FIG. 1 along a direction along a nozzle array direction (longitudinal direction of common liquid chamber) in which nozzles are arrayed in row.

FIG. 3 is an enlarged cross-sectional view of a main body of the liquid discharge head 404 of FIG. 2.

The liquid discharge head 404 includes a head main body 100 and a liquid supply member 200. The head main body 100 includes a nozzle face 1*a* in which a plurality of nozzles 4 to discharge liquid is formed. The liquid supply member 200 includes a liquid supply channel 201 communicating with a common liquid chamber 10 inside the head main body 100 to supply liquid to the head main body 100.

As illustrated in FIG. 3, the head main body 100 includes a nozzle plate 1, an actuator substrate 20, a common-chamber substrate 70, and a damper 90. Nozzles 4 are formed in the nozzle plate 1. The actuator substrate 20 includes an individual channel and a pressure-generating element (pressure generator). The common-chamber substrate 70 forms common liquid chamber 10. The damper 90 forms a wall of the common liquid chamber 10. A side of the damper 90 opposite the common liquid chamber 10 forms a damper chamber 95.

The common-chamber substrate 70 includes a connection channel 71 communicating with the common liquid chamber 10. The connection channel 71 communicates with liquid supply channel 201 of the liquid supply member 200.

As illustrated in FIG. 2, the liquid supply member 200 includes a first member 211 disposed on the head main body 100 side, an elastic member 213, and a second member 212 fixed to the first member 211 via the elastic member 213.

The second member 212 includes a vertical channel 201A that forms a part of the liquid supply channel 201. The vertical channel 201A is formed by a through-hole penetrating the second member 212 in a direction perpendicular to the surface of the nozzle face 1*a*. A connecting portion 214 is provided at an entrance side of the vertical channel 201A. The connecting portion 214 is connected to an external liquid storage directly or via a supply tube.

The first member 211 includes a vertical channel 201C as a second channel that forms a part of the liquid supply channel 201. The vertical channel 201C is formed by a through-hole penetrating the first member 211 in a direction perpendicular to the surface of the nozzle face 1*a*. The first member 211 further includes a lateral channel 201B served as a first channel that forms a part of the liquid supply channel 201. The lateral channel 201B is a recess formed along the nozzle face 1*a*.

The lateral channel 201B connects the vertical channel 201A with the vertical channel 201C. An upstream of the lateral channel 201B communicates with the vertical channel 201A and a downstream of the lateral channel 201B communicates with the vertical channel 201C. Thus, the liquid flows from the connecting portion 214 to the head main body 100 through the vertical channel 201A, the lateral channel 201B, and the vertical channel 201C in a liquid direction of flow.

A wall of the lateral channel 201B of the first member 211 on the second member 212 side is formed by the elastic member 213. The portion of the elastic member 213 forming the wall of the lateral channel 201B becomes a damper 209. The elastic member 213 includes a channel 201D formed with a through-hole that communicates the vertical channel 201A of the second member 212 with the lateral channel 201B of the first member 211. This elastic member 213 also serves as a sealing member for sealing a portion between the first member 211 and the second member 212 by a sheet gasket.

Here, in a state where the elastic member 213 is sandwiched between the first member 211 and the second member 212, the first member 211 and the second member 212 are fixed to each other by a fixing member such as a screw or a bolt. Thus, the elastic member 213 is pressed between the first member 211 and the second member 212.

As illustrated in FIG. 2, bolts 206 that serve as a fixing member are inserted into fixing holes 205 (See FIGS. 11 to 16) to fix the first member 211 and the second member 212. The bolts 206 sandwich and press the elastic member 213 between the first member 211 and the second member 212 to fix (join) the first member 211 and the second member 212 together.

Further, the second member 212 is provided with a gas chamber 215 as a damper chamber on the opposite side of the lateral channel 201B of the first member 211 via a portion of the damper 209 of the elastic member 213.

Due to such a configuration, a part of the pressure fluctuation transmitted to the common liquid chamber 10 attendant upon a liquid discharge operation and not absorbed by the damper 90 propagates to the liquid supply channel 201. Then, the pressure fluctuation is absorbed or suppressed by the damper 209 of the elastic member 213 constituting the wall of the lateral channel 201B.

Therefore, the present embodiment can absorb or suppress the pressure fluctuation more efficiently than the configuration that includes the damper 90 in the common liquid chamber 10. Thereby, the present embodiment can perform stable liquid discharge operation.

Further, the elastic member 213 serves as a seal member for sealing between the first member 211 and the second member 212 and also serves as a damper forming a wall of a part of the liquid supply channel 201. Thereby, the present embodiment can reduce the number of parts due to providing the damper in the liquid supply channel 201.

Figure 4:
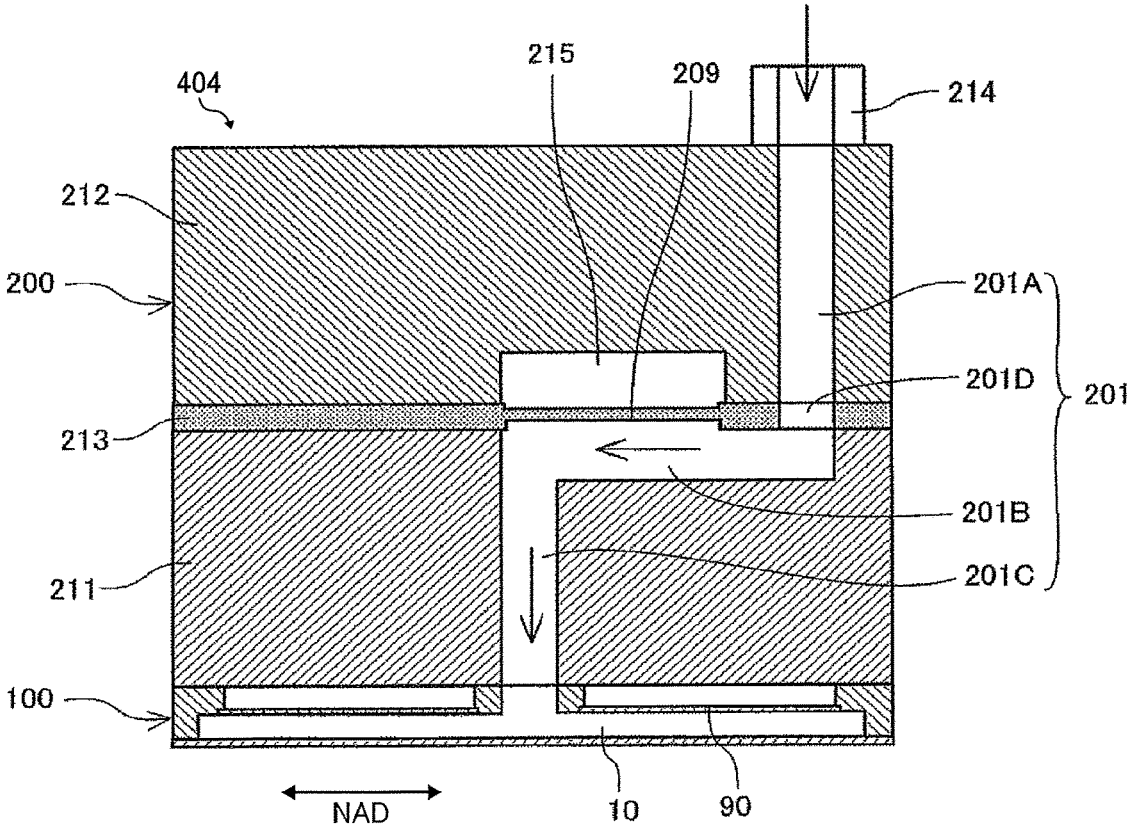
FIG. 4 is a cross-sectional view of the liquid discharge head along the nozzle array direction (longitudinal direction of common liquid chamber) according to a second embodiment of the present disclosure.
Figure 5:
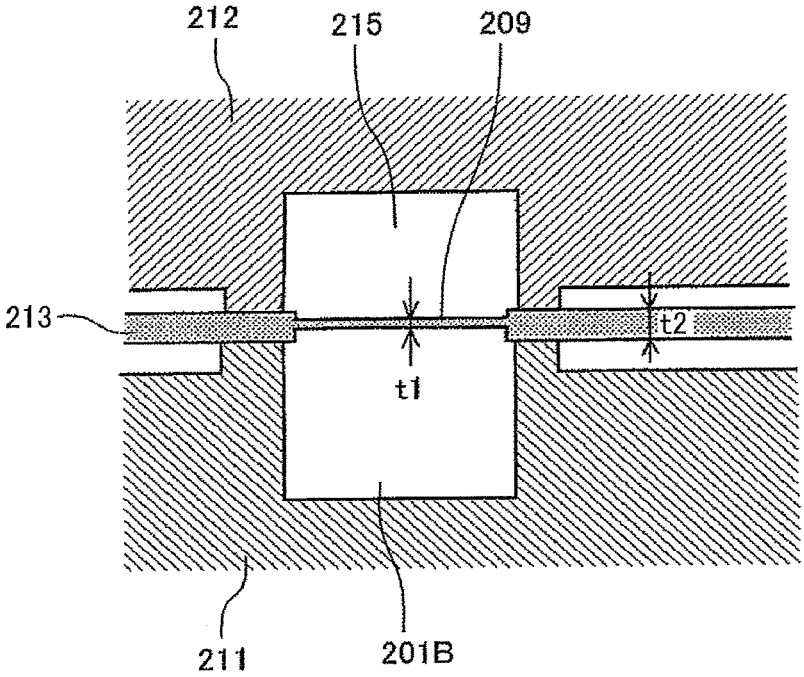
FIG. 5 is an enlarged cross-sectional view of a channel portion of the liquid discharge head along a direction perpendicular to the nozzle array direction (transverse direction of common liquid chamber)

A second embodiment according to the present disclosure is described with reference to FIGS. 4 and 5. FIG. 4 is a cross-sectional view of the liquid discharge head 404 along a direction along a nozzle array direction (NAD, a longitudinal direction of common liquid chamber) in which nozzles 4 are arrayed in rows. FIG. 5 is an enlarged cross-sectional view of a channel portion of the liquid discharge head 404 along a direction perpendicular to the nozzle array direction (NAD) (transverse direction of common liquid chamber) in which nozzles are arrayed in rows.

As illustrated in FIG. 5, the thickness t1 of the damper 209 in a portion that forms the wall of the lateral channel 201B is made thinner than the thickness t2 of the other portion of the elastic member 213. A part of the elastic member 213 that faces the lateral channel 201B and the gas chamber 215 serves as the damper 209.

As a result, while the elastic member 213 reliably seals the space between the first member 211 and the second member 212, greater displacement is possible in the lateral channel 201B, thereby improving the damper function.

Figure 6:
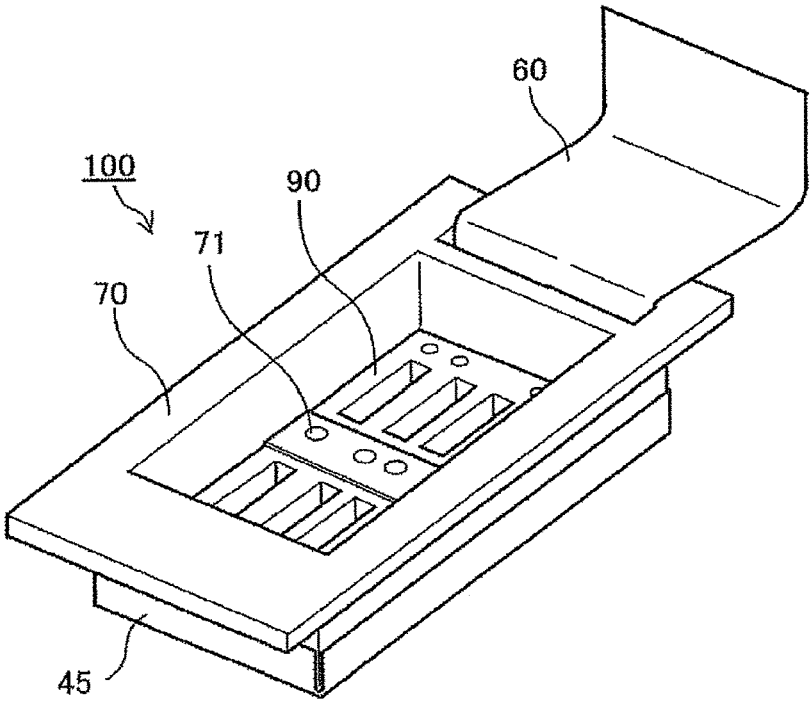
FIG. 6 is a perspective view of an example of a head main body.
Figure 7:
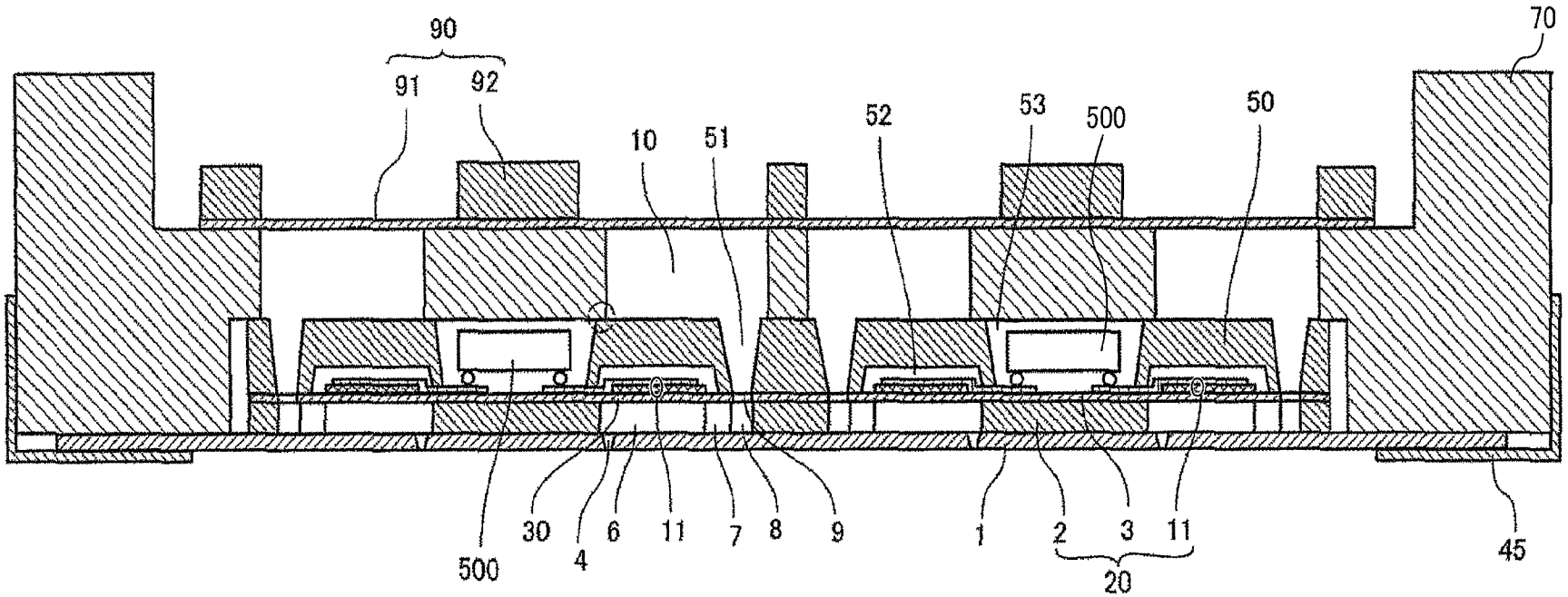
FIG. 7 is a cross-sectional view of the head main body along the direction perpendicular to the nozzle array direction.
Figure 8:
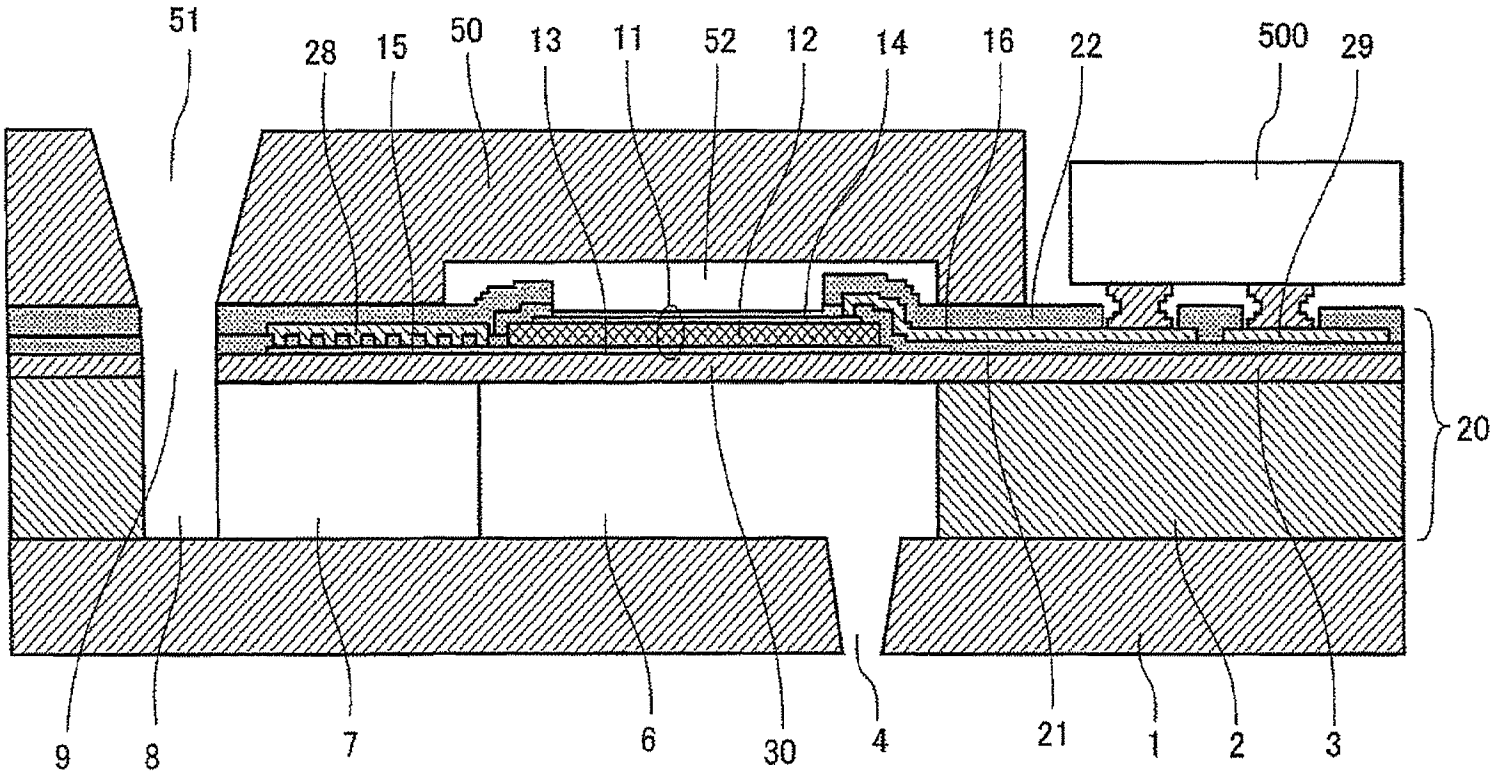
FIG. 8 is an enlarged cross-sectional view of a portion of the head main body of FIG. 7.
Figure 9:
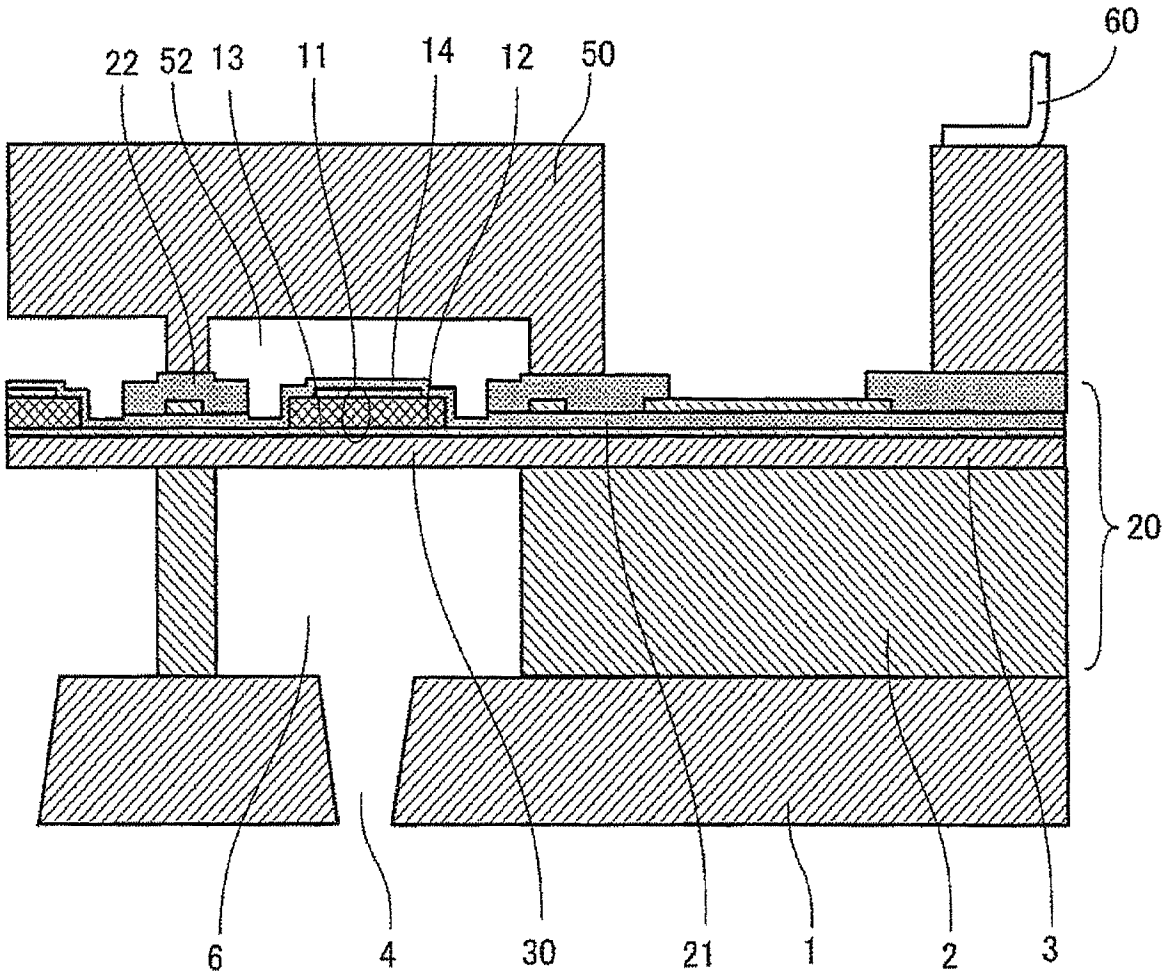
FIG. 9 is a cross-sectional view of a portion of the head main body along the nozzle array direction.

An example of the head main body is described with reference to FIGS. 6 to 9. FIG. 6 is a perspective view of the head main body 100. FIG. 7 is a cross-sectional view of the head main body 100 along the direction perpendicular to the nozzle array direction (NAD). FIG. 8 is an enlarged cross-sectional view of a portion of the head body of FIG. 7. FIG. 9 is a cross-sectional view of a portion of the head main body 100 along the nozzle array direction (NAD).

The head main body 100 includes a nozzle plate 1, a channel plate 2, a diaphragm 3, piezoelectric elements 11, a holding substrate 50, a wiring member 60, a common-chamber substrate 70, and a cover 45. The diaphragm 3 forms a wall of an individual liquid chamber 6. The piezoelectric elements 11 serves as the pressure-generating elements (pressure generators). The wiring member 60 includes a flexible printed circuit (FPC).

Here, an actuator substrate 20 includes a part constituted by the channel plate 2, the diaphragm 3, and the piezoelectric element 11.

The nozzle plate 1 includes a plurality of nozzles 4 to discharge liquid. As illustrated in FIG. 7, the nozzles 4 are arrayed in four rows to form four nozzle arrays.

With the nozzle plate 1 and the diaphragm 3, the channel plate 2 forms individual liquid chambers 6 communicated with the nozzles 4, fluid restrictors 7 communicated with the individual liquid chambers 6, and liquid introduction portions 8 communicated with the fluid restrictors 7.

The liquid introduction portions 8 are communicated with the common liquid chamber 10 formed by the common-chamber substrate 70 via slot 9 of the diaphragm 3 and an opening 51 served as a channel of the holding substrate 50.

The diaphragm 3 includes deformable vibration portions 30 forming part of wall of the individual liquid chambers 6. The piezoelectric element 11 is disposed integrally with the vibration portion 30 on a face of the vibration portion 30 of the diaphragm 3 opposite the individual liquid chamber 6. The vibration portion 30 and the piezoelectric element 11 form a piezoelectric actuator.

In the piezoelectric element 11, a lower electrode 13, a piezoelectric layer (piezoelectric body) 12, and an upper electrode 14 are laminated in this order from the vibration portion 30. An insulation film 21 is formed on the piezoelectric element 11.

The lower electrode 13 as a common electrode for the plurality of piezoelectric elements 11 is connected to a common-electrode power-supply wiring pattern 28 via a common wire 15. The lower electrode 13 is a single electrode layer formed across entire of the piezoelectric elements 11 in the nozzle array direction (NAD).

The upper electrodes 14 as individual electrodes for the piezoelectric elements 11 are connected to a drive integrated circuit (IC) 500 (hereinafter, driver IC 500) as a drive circuit via individual wires 16. The individual wire 16 is covered with an insulation film 22.

The driver IC 500 is mounted on the actuator substrate 20 by a flip-chip bonding method, for example, to cover an area between rows of the piezoelectric elements 11.

The driver IC 500 mounted on the actuator substrate 20 is connected to an individual-electrode power-supply wiring pattern 29 to which a drive waveform (drive signal) is supplied.

One end of a wire provided at the wiring member 60 is electrically connected to the driver IC 500. Another end of the wiring member 60 is connected to a controller of an apparatus body.

The holding substrate 50 covering the piezoelectric element 11 on the actuator substrate 20 is bonded, with adhesive, to one side of the actuator substrate 20 on which the diaphragm 3 is disposed.

The holding substrate 50 includes openings 51, recesses 52, and openings 53. The openings 51 serves as a part of channel that communicates the common liquid chambers 10 with the individual liquid chambers 6. The recesses 52 accommodate the piezoelectric elements 11. The openings 53 accommodate the driver IC 500 disposed on the actuator substrate 20. The openings 51 are slit-shaped through-holes extending along the nozzle array direction NAD. The openings 51 forms a part of the common liquid chamber 10.

The holding substrate 50 is interposed between the actuator substrate 20 and the common-chamber substrate 70 to form a wall of the common liquid chamber 10.

The common-chamber substrate 70 forms the common liquid chamber 10 that supplies the liquid to each of the individual liquid chambers 6. Note that, in the present embodiment, the four common liquid chambers 10 are disposed corresponding to the four nozzle arrays. Desired colors of liquids are supplied to the respective common liquid chambers 10 via the connection channels 71 communicating with the liquid supply member 200.

A damper 90 is bonded to the common-chamber substrate 70. The damper 90 includes a damper 91 and damper plates 92. The damper 91 is deformable and forms part of wall of the common liquid chamber 10. The damper plates 92 reinforce the damper 91. The damper 90 forms a wall of the common liquid chamber 10.

The common-chamber substrate 70 is bonded to the holding substrate 50 and an outer peripheral portion of the nozzle plate 1 with adhesive. The common-chamber substrate 70 accommodates the actuator substrate 20 and the holding substrate 50, thus forming a frame of this liquid discharge head 404.

Covers 45 are disposed to cover part of a peripheral are of the nozzle plate 1 and part of outer circumferential faces of the common-chamber substrate 70.

In this head main body 100, voltage is applied from the driver IC 500 to a portion between the upper electrode 14 and the lower electrode 13 of the piezoelectric element 11. Accordingly, the piezoelectric layer 12 expands in an electrode lamination direction (in other words, an electric-field direction) in which the upper electrode 14 and the lower electrode 13 are laminated, and contracts in a direction parallel to the vibration portion 30. Thus, tensile stress arises at a lower electrode 13 side of the vibration portion 30 facing the lower electrode 13. This tensile stress causes the vibration portion 30 to bend toward an individual liquid chamber 6 side of the vibration portion 30 facing the individual liquid chamber 6. Accordingly, liquid within the individual liquid chamber 6 is pressurized and discharged from the nozzle 4.

Next, a liquid supply member according to a third embodiment of the present disclosure is described with reference to FIGS. 10 to 17.

Figure 10:
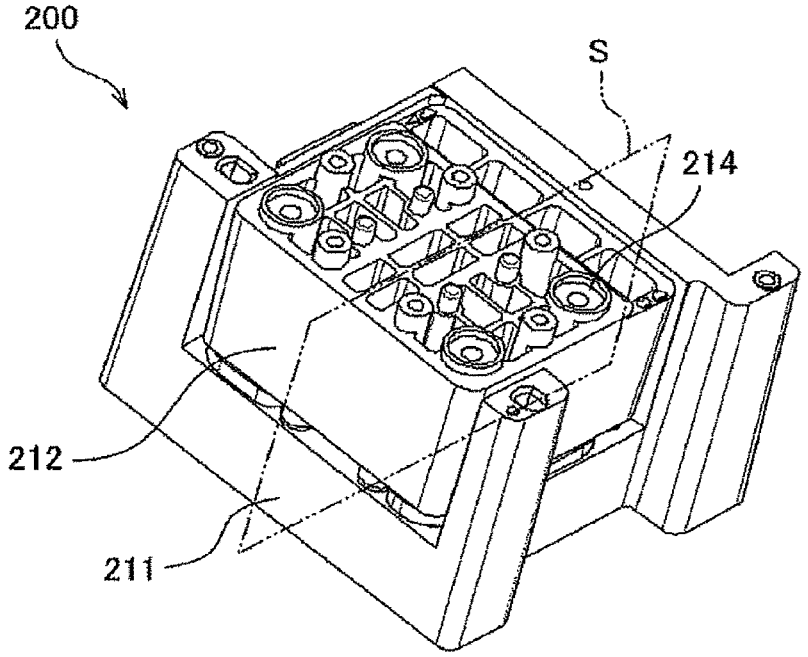
FIG. 10 is a perspective view of the liquid supply member according to a third embodiment of the present disclosure.

FIG. 10 is a perspective view of the liquid supply member 200 according to the present embodiment.

Figure 11:
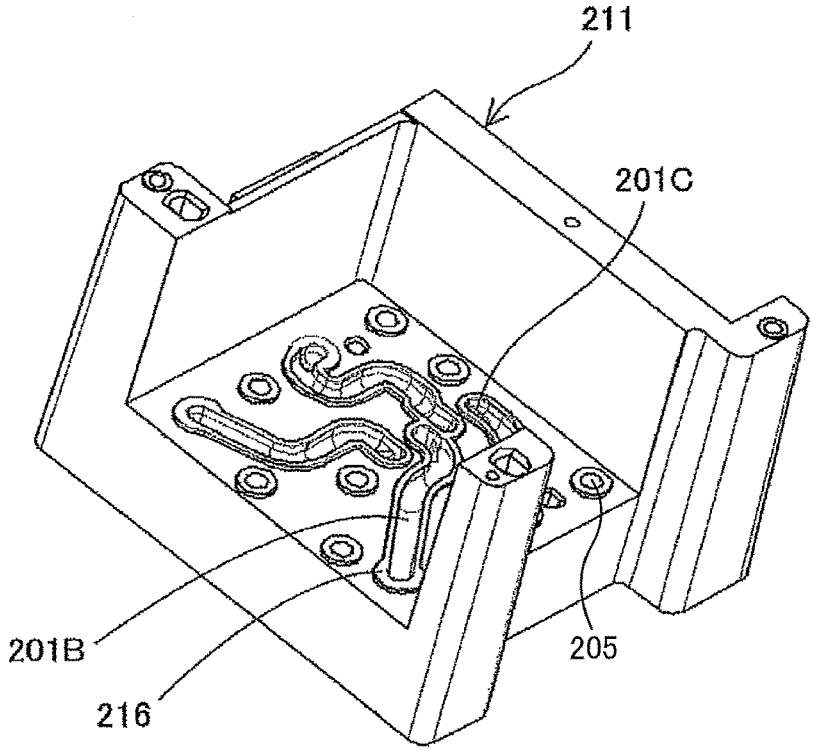
FIG. 11 is a perspective view of a first member as a lower case seen from the upper surface side of the first member.

FIG. 11 is a perspective view of the first member 211 as a lower case as viewed from the upper surface side of the first member 211.

Figure 12:
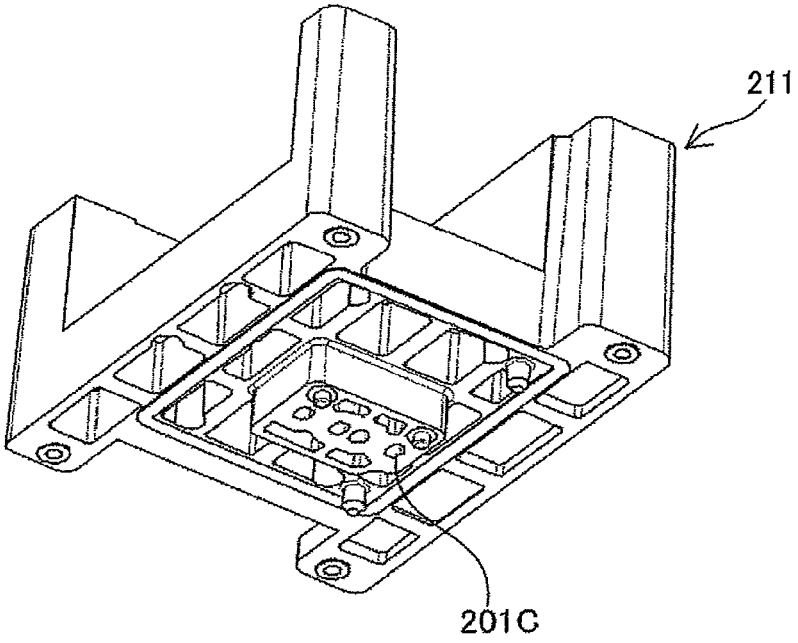
FIG. 12 is a perspective view of the first member seen from a lower surface side of the first member.

FIG. 12 is a perspective view of the first member 211 as viewed from the lower surface side of the first member 211.

Figure 13:
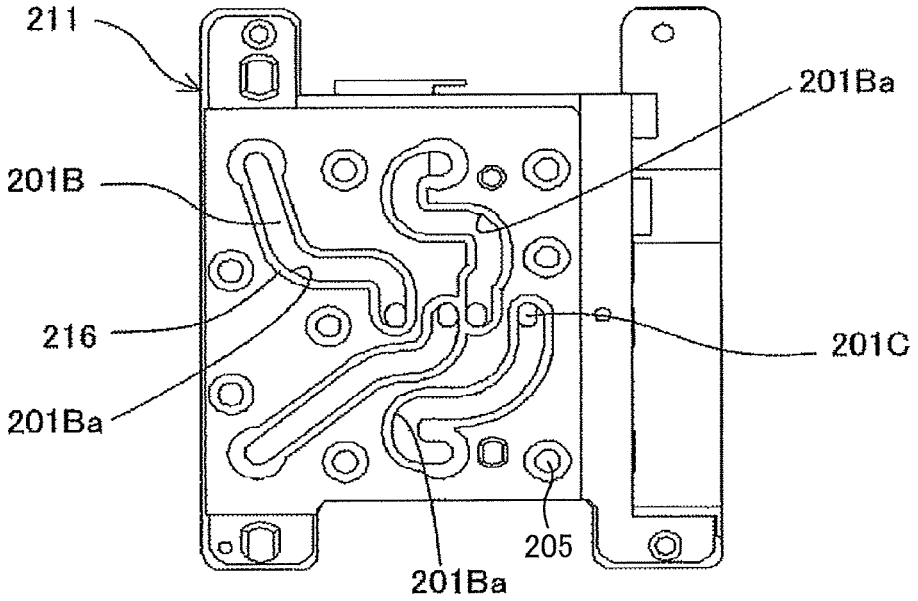
FIG. 13 is a plan view of the first member.

FIG. 13 is a plan view of the first member 211.

Figure 14:
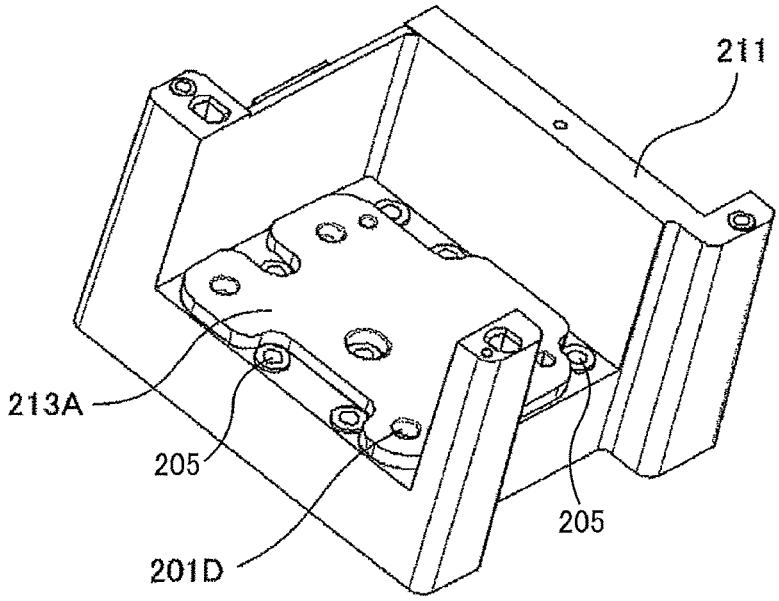
FIG. 14 is a perspective view of the first member in a state in which an elastic member is disposed on the first member.

FIG. 14 is a perspective view of the first member 211 in a state in which the elastic member 213 is disposed on the first member 211.

Figure 15:
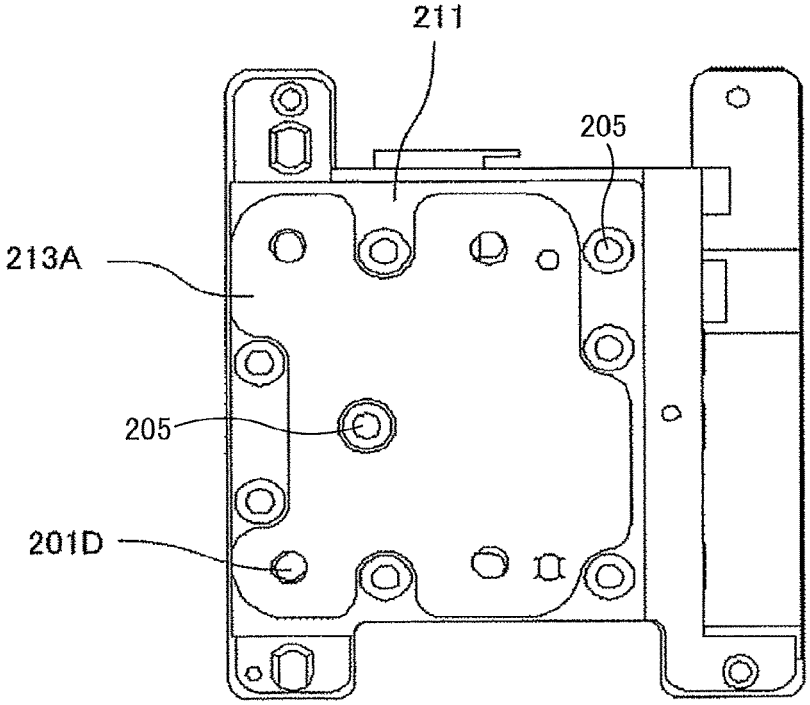
FIG. 15 is a plan view of the first member in the state in which the elastic member is disposed on the first member.

FIG. 15 is a plan view of the first member 211 in a state in which the elastic member 213 is disposed on the first member 211.

Figure 16:
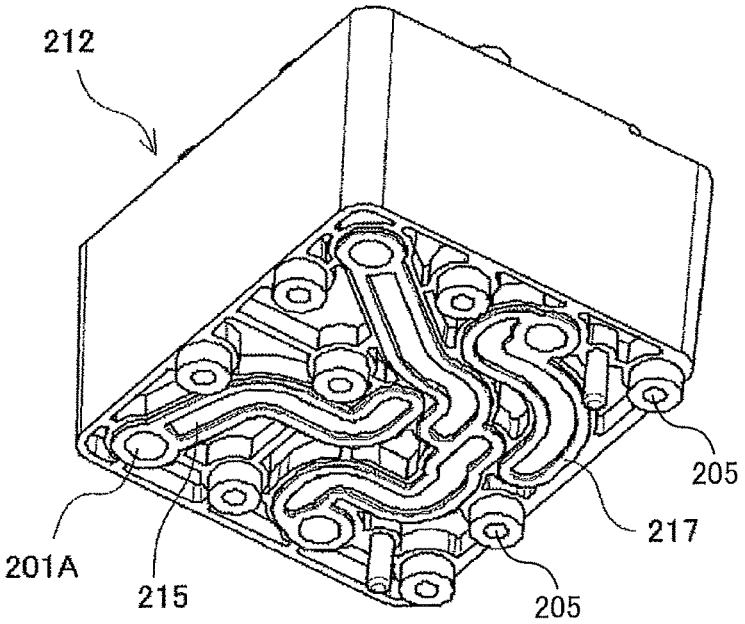
FIG. 16 is a perspective view of the second member as an upper case as viewed from the first member side.

FIG. 16 is a perspective view of the second member 212 as the upper case as viewed from the first member 211 side.

Figure 17:
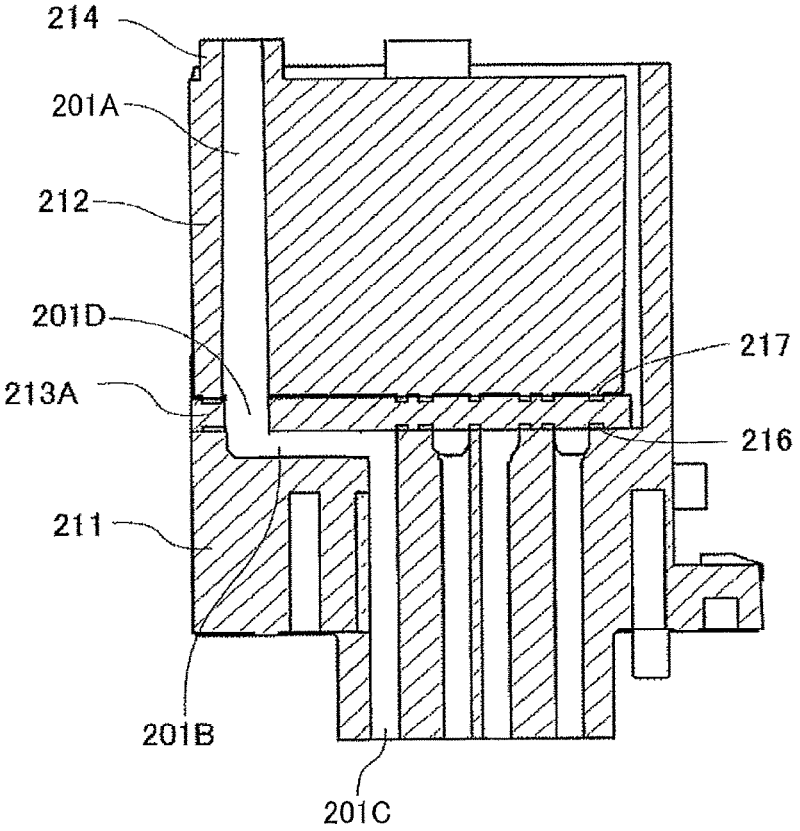
FIG. 17 is a cross-sectional view of a liquid supply channel of a liquid supply member connected to the head main body.

FIG. 17 is a cross-sectional view of the liquid supply member 200 taken along a plane S of FIG. 10 that is along the liquid direction of flow in the vertical channels 201A and 201C connected to the head main body 100.

As illustrated in FIG. 11, on the upper surface of the first member 211, a plurality of (here, four) channels, that is, lateral channel 201B are formed so as to creep on the upper surface of the first member 211. The lateral channel 201B includes a bent portion 201Ba. The bent portion 201Ba changes a direction of flow of the liquid in the middle of the lateral channel 201B formed along a direction of the nozzle face 1*a*. Thus, the first channel (lateral channel 201B) includes the bent portion 201Ba that changes a direction of flow of the liquid in the liquid supply channel 201 along the direction of the nozzle face 1*a*.

In the plurality of lateral channels 201B, convex ribs 216 are formed at the peripheral portions of each lateral channels 201B so as to surround the lateral channels 201B.

As illustrated in FIG. 13, one end of the lateral channel 201B of the first member 211 is arranged at a narrow pitch (interval) so as to communicate with the connection channel 71 of the head main body 100. The vertical channel 201C is arranged in this one end of the lateral channel 201B to communicate with the lateral channel 201B.

On the other hand, another end of the lateral channel 201B is wound around the upper surface of the first member 211 with a wider interval (pitch) between the lateral channels 201B than the interval (pitch) of one end of the lateral channel 201B. Thus, the other end of the lateral channel 201B matches a position communicating with an outlet of the vertical channel 201A of the second member 212 as an upper case.

A packing 213A, which is a sheet-like elastic member, is disposed across the plurality of lateral channels 201B of the first member 211. The packing 213A forms a wall of the plurality of lateral channels 201B including the bent portion 201Ba. By covering the plurality of lateral channels 201B with a single packing 213A, it is possible to easily cover all the lateral channels 201B including the bent portion 201Ba when the lateral channel 201B includes the bent portion 201Ba.

As illustrated in FIGS. 14 and 15, in the packing 213A, the channels 201D are arranged with a wide pitch (interval). The channels 201D are formed by through-holes for communicating the vertical channel 201A of the second member 212 with the lateral channel 201B of the first member 211.

The packing 213A has a minimum size that covers the convex rib 216 formed to surround one lateral channel 201B. Instead of one sheet-like packing 213A, a plurality of packings covering each of the lateral channels 201B may be arranged on the surface of the first member 211.

As illustrated in FIGS. 16 and 17, a vertical channel 201A is formed in the second member 212. Ribs 217 surrounding the peripheral area of the vertical channels 201A are formed on the packing 213A side of the surface of the vertical channel 201A of the second member 212. Further, a recessed portion that becomes the gas chamber 215 is formed in the second member 212. The recessed portion has an inverted form of the lateral channel 201B The rib 217 surrounding the peripheral area of the gas chamber 215 is formed on a surface of the second member 212.

Thus, the packing 213A is sandwiched and crushed between the convex rib 216 of the first member 211 and the rib 217 of the second member 212 to reliably seal the space between the first member 211 and the second member 212.

The liquid supply member 200 as described above is configured by fixing the first member 211 and the second member 212 with a fastening member while sandwiching the packing 213A with the first member 211 and the second member 212 to become a state as illustrated in FIG. 10.

At this time, the convex rib 216 of the first member 211 and the rib 217 of the second member 212 crush the packing 213A for a specified amount to seal the space between the first member 211 and the second member 212. The packing 213A serves as an elastic member. The packing 213A seals the lateral channels 201B to divide the lateral channels 201B into respective sections.

As a result, the wall of the lateral channel 201B on the second member 212 side is formed by the packing 213A served as an elastic member.

Therefore, excessive pressure or pressure propagation, for example, existed in the lateral channel 201B is absorbed by deformation of the packing 213A served as an elastic wall. In this case, the deformation of the packing 213A is suppressed by the second member 212 and the damper effect may not be reliably exhibited without the gas chamber 215.

In each of the above-described embodiments, an example in which a part of a liquid supply channel 201 of the liquid supply member 200 is formed by the second member 212 is described. However, the second member 212 may have a configuration in which the liquid supply channel 201 of the liquid supply member 200 is not formed in the second member 212.

Figure 18:
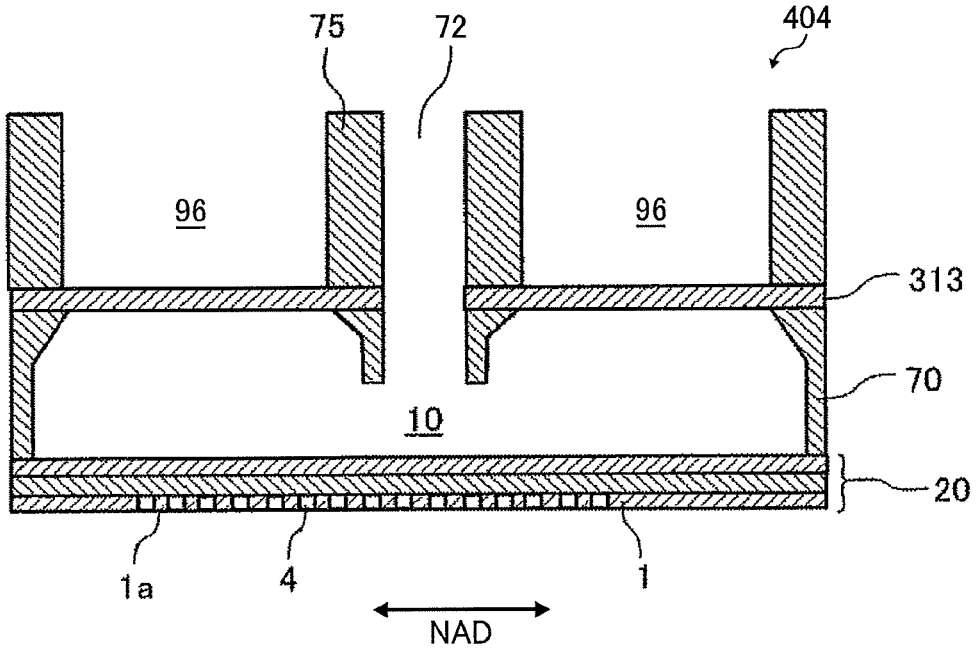
FIG. 18 is a cross-sectional view of the liquid discharge head according to a fourth embodiment of the present disclosure along the nozzle array direction (longitudinal direction of the individual liquid chamber)

A fourth embodiment according to the present disclosure is described with reference to FIG. 18. FIG. 18 is a cross-sectional view of a main part of the liquid discharge head 404 along the nozzle array direction (NAD, longitudinal direction of the individual liquid chamber) according to the fourth embodiment.

The liquid discharge head 404 includes the common-chamber substrate 70 and a liquid supply member 75. The common-chamber substrate 70 forms the common liquid chamber 10 that supplies the liquid to a plurality of the individual liquid chambers 6. The plurality of individual liquid chambers 6 respectively communicates with the plurality of nozzles 4, from which the liquid is discharged. The liquid supply member 75 forms a liquid supply path 72 that supplies the liquid to the common liquid chamber 10.

The liquid discharge head 404 further includes an elastic member 313 that is pressed between the common-chamber substrate 70 and the liquid supply member 75. The elastic member 313 forms a wall of the common liquid chamber 10. The liquid discharge head 404 includes a gas chamber 96 disposed on an opposite side of the common liquid chamber 10 via the elastic member 313.

Further, the elastic member 313 serves as a seal member for sealing between the common-chamber substrate 70 and the liquid supply member 75 and also serves as a damper forming a wall of the common liquid chamber 10. Thereby, the present embodiment can reduce the number of parts due to providing the damper in the liquid discharge head 404.

Figure 19:
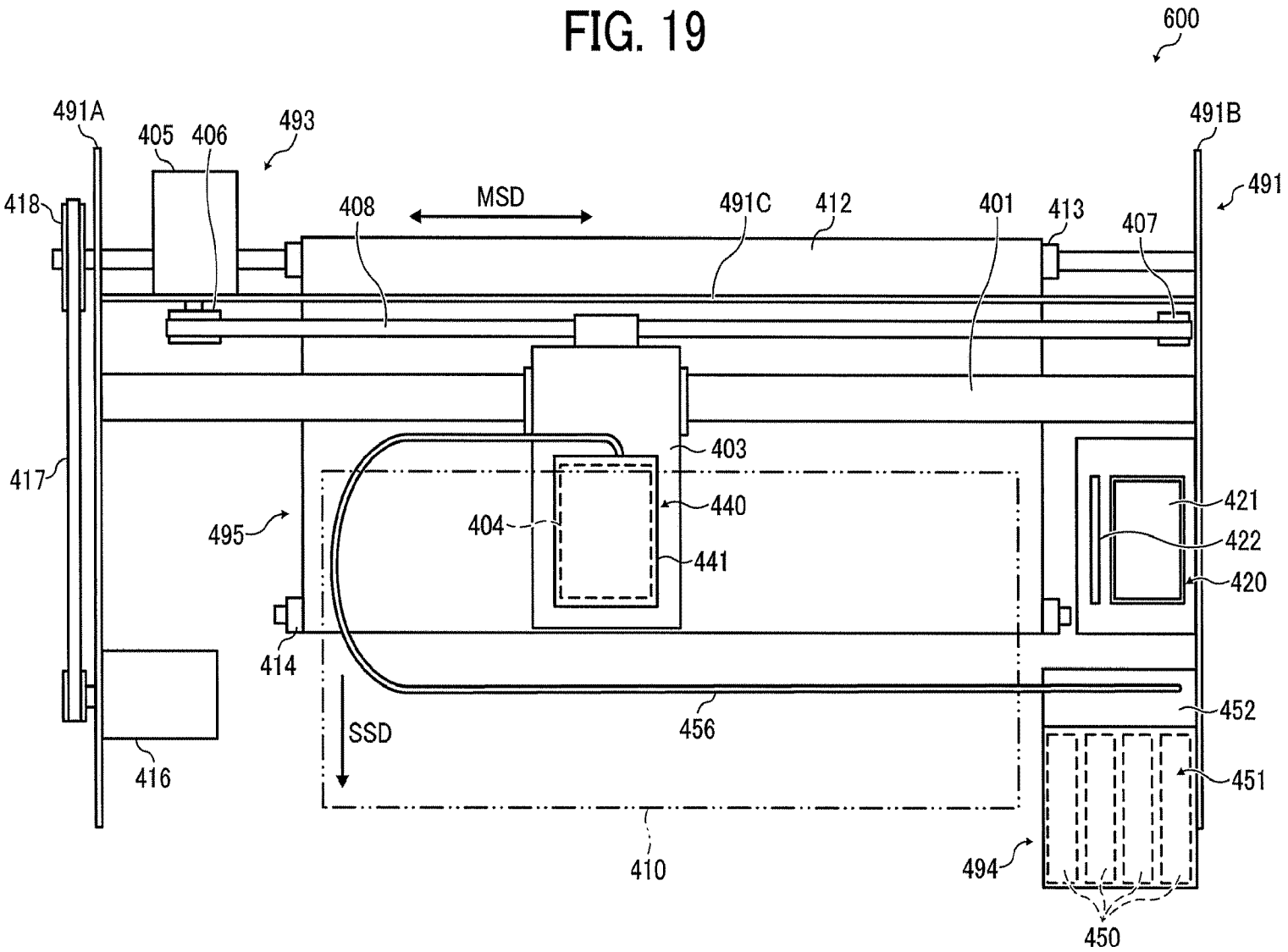
FIG. 19 is a plan view of a portion of a liquid discharge apparatus according to embodiments of the present disclosure.
Figure 20:
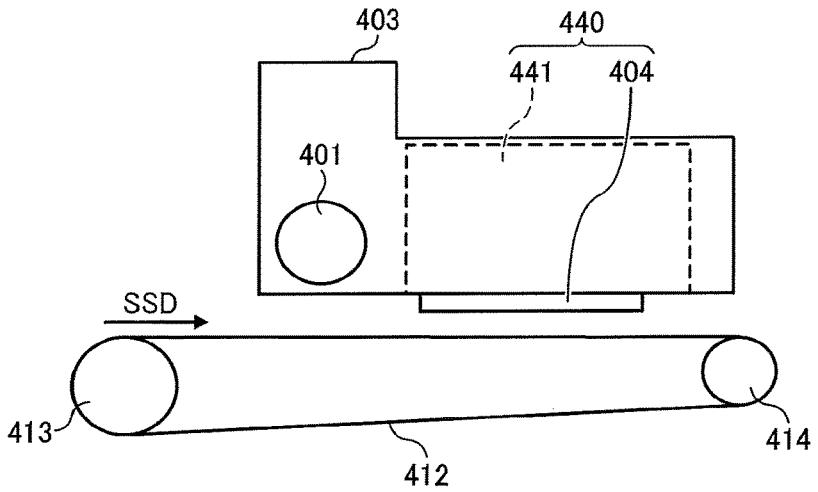
FIG. 20 is a side view of a portion of the liquid discharge apparatus.

FIGS. 19 and 20 illustrate an example of a liquid discharge apparatus 600 according to the present embodiment. FIG. 19 is a plan view of a main part of the liquid discharge apparatus 600. FIG. 20 is a side view of a portion of the liquid discharge apparatus 600.

The liquid discharge apparatus 600 is a serial-type apparatus in which a main scan moving unit 493 reciprocally moves a carriage 403 in a main scanning direction indicated by arrow MSD in FIG. 19. The main scan moving unit 493 includes a guide 401, a main scanning motor 405, a timing belt 408, etc. The guide 401 is laterally bridged between a left side plate 491A and a right side plate 491B. The guide 401 supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 according to the present embodiment and a head tank 441 are integrated as a single unit. The liquid discharge head 404 of the liquid discharge device 440 discharges color liquids of, for example, yellow (Y), cyan (C), magenta (M), and black (K).

The liquid discharge head 404 includes nozzle arrays, each including a plurality of nozzles 4 arrayed in row in a sub-scanning direction indicated by arrow SSD in FIGS. 19 and 20. The sub-scanning direction (SSD) is perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 600 includes a conveyance unit 495 to convey a sheet 410. The conveyance unit 495 includes a conveyance belt 412 as a conveyor and a sub-scanning motor 416 to drive the conveyance belt 412.

The conveyance belt 412 attracts the sheet 410 and conveys the sheet 410 at a position facing the liquid discharge head 404. The conveyance belt 412 is in the form of an endless belt. The conveyance belt 412 is stretched between a conveyance roller 413 and a tension roller 414. The sheet 410 is attracted to the conveyance belt 412 by electrostatic force or air suction.

The conveyance roller 413 is rotated by a sub-scanning motor 416 via a timing belt 417 and a timing pulley 418, so that the conveyance belt 412 circulates in a sub-scanning direction indicated by arrow SSD in FIGS. 19 and 20.

At one side in the main scanning direction MSD of the carriage 403, a maintenance device 420 to recover the liquid discharge head 404 in good condition is disposed on a lateral side (right-hand side) of the conveyance belt 412 in FIG. 19.

The maintenance device 420 includes, for example, a cap 421 to cap a nozzle face (i.e., a face on which the nozzles are formed) 1*a* of the liquid discharge head 404 and a wiper 422 to wipe the nozzle face.

The main scan moving unit 493, the supply unit 494, the maintenance device 420, and the conveyance unit 495 are mounted to a housing 491 that includes the left side plate 491A, the right side plate 491B, and a rear side plate 491C.

In the liquid discharge apparatus 600 thus configured, a sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 600 includes the liquid discharge head 404 according to the present embodiment, thus allowing stable formation of high quality images.

Figure 21:
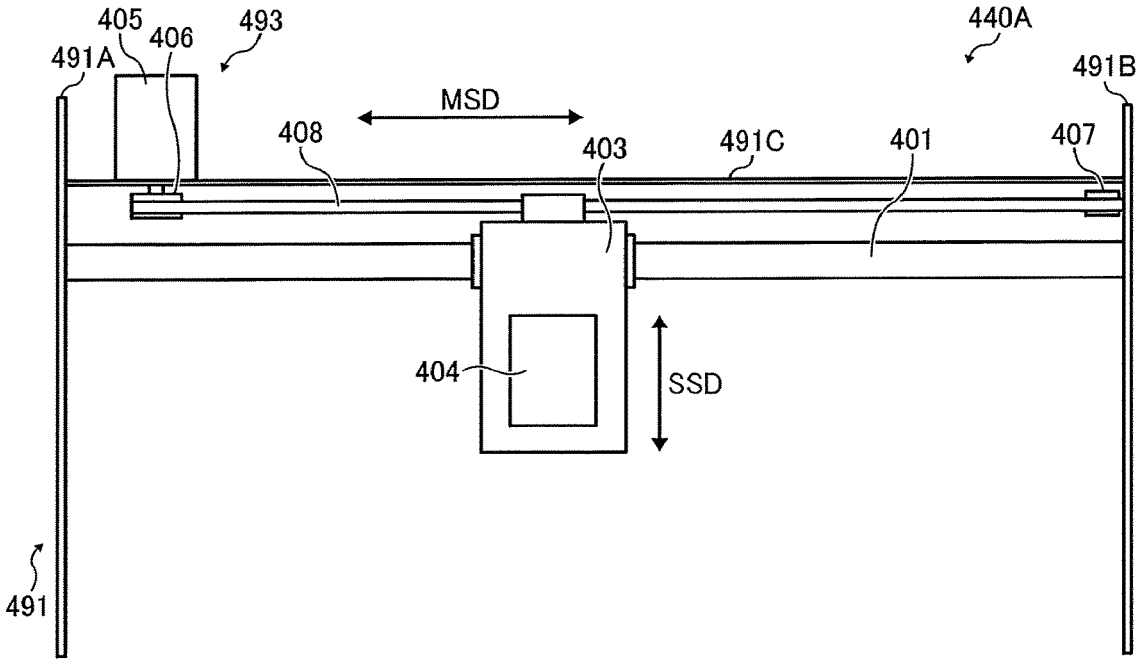
FIG. 21 is a plan view of a portion of a liquid discharge device.

FIG. 21 illustrates another example of the liquid discharge device 440A according to an embodiment of the present disclosure. FIG. 21 is a plan view of a main part of the liquid discharge device 440A.

The liquid discharge device 440A includes the housing 491, the main scan moving unit 493, the carriage 403, and the liquid discharge head 404 among components of the liquid discharge apparatus 600. The left side plate 491A, the right side plate 491B, and the rear side plate 491C constitute the housing 491.

Note that, in the liquid discharge device 440A, at least one of the maintenance device 420 and the supply unit 494 described above may be mounted on, for example, the right side plate 491B.

Figure 22:
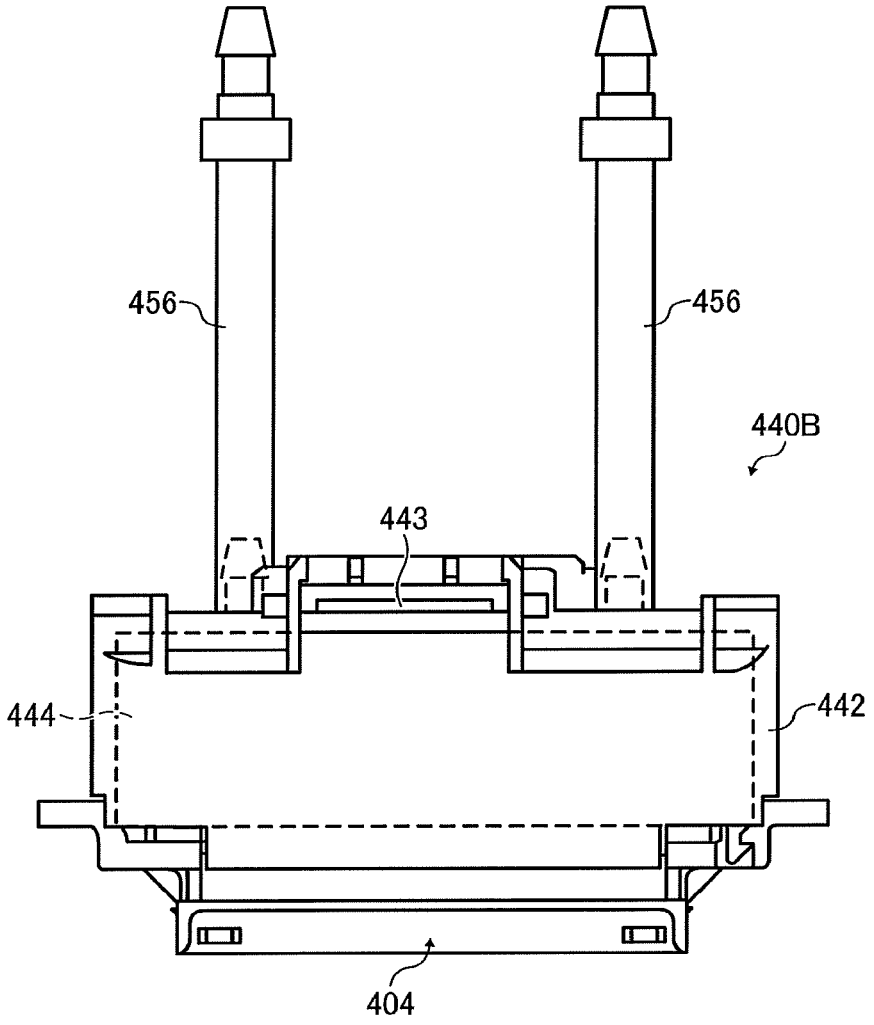
FIG. 22 is a front view of another example of the liquid discharge device.

FIG. 22 illustrates still another example of the liquid discharge device 440B according to an embodiment of the present disclosure. FIG. 22 is a front view of the liquid discharge device 440B.

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

"The liquid discharge device" is an integrated unit including the liquid discharge head and a functional part(s) or unit(s), and is an assembly of parts relating to liquid discharge. For example, "the liquid discharge device" may be a combination of the liquid discharge head with at least one of a head tank, a carriage, a supply unit, a maintenance device, and a main scan moving unit.

Herein, the terms "integrated" or "united" mean fixing the liquid discharge head and the functional parts (or mechanism) to each other by fastening, screwing, binding, or engaging and holding one of the liquid discharge head and the functional parts movably relative to the other. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

The liquid discharge device may be an integrated unit in which a liquid discharge head is integrated with a carriage.

The liquid discharge device may be the liquid discharge head movably held by a guide that forms part of a main scan moving unit, so that the liquid discharge head and the main scan moving unit are integrated as a single unit. The liquid discharge device may include the liquid discharge head, the carriage, and the main scan moving unit that are integrated as a single unit.

In another example, the cap that forms part of the maintenance device is secured to the carriage mounting the liquid discharge head so that the liquid discharge head, the carriage, and the maintenance device are integrated as a single unit to form the liquid discharge device.

Further, the liquid discharge device may include tubes connected to the liquid discharge head mounted on the head tank or the channel member so that the liquid discharge head and the supply assembly are integrated as a single unit. Liquid is supplied from a liquid reservoir source such as liquid cartridge to the liquid discharge head through the tube.

The main scan moving unit may be a guide only. The supply unit may be a tube(s) only or a mount part (loading unit) only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a liquid discharge head and a medium on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzles to discharge liquid;

a plurality of individual liquid chambers, each communicating with a respective one of the plurality of nozzles;

a common liquid chamber to supply the liquid to the plurality of individual liquid chambers;

a liquid supply member including a liquid supply channel to supply the liquid to the common liquid chamber, a first member including a part of the liquid supply channel, a second member including a gas chamber, and an elastic member disposed between the first member and the second member and forming a wall of the liquid supply channel of the first member and a wall of the gas chamber of the second member, the gas chamber of the second member disposed opposite the liquid supply channel of the first member via the elastic member; and a nozzle face in which the plurality of nozzles are formed, wherein the liquid supply channel of the first member includes a first channel formed in a direction along the nozzle face of the liquid discharge head, the first member includes a first rib formed at a peripheral portion of the first channel so as to surround the first channel, the second member includes a second rib formed at a peripheral portion of the gas chamber so as to surround the gas chamber; and the elastic member is sandwiched and pressed between the first rib and the second rib.

2. The liquid discharge head according to claim 1, further comprising a fixing member to join the first member and the second member while sandwiching and pressing the elastic member between the first member and the second member.

3. The liquid discharge head according to claim 1, wherein the liquid supply channel of the first member includes a second channel formed in a direction perpendicular to the nozzle face and communicating with a downstream portion of the first channel.

4. The liquid discharge head according to claim 3, wherein the second channel faces a portion of the elastic member where the elastic member faces the gas chamber.

5. The liquid discharge head according to claim 1, further comprising a damper that forms a wall of the common liquid chamber.

6. The liquid discharge head according to claim 1, wherein a portion of the elastic member that forms the wall of the liquid supply channel has a thickness different from a thickness of another portion of the elastic member that does not form the wall of the liquid supply channel.

7. The liquid discharge head according to claim 6, wherein a portion of the elastic member that forms the wall of the liquid supply channel is thinner than another portion of the elastic member that does not form the wall of the liquid supply channel.

8. The liquid discharge head according to claim 1, wherein the first channel includes a bent portion that changes a direction of flow of the liquid in the liquid supply channel along the direction of the nozzle face.

9. The liquid discharge head according to claim 1, further comprising another liquid supply channel, wherein the elastic member is a sheet disposed across the liquid supply channel and the another liquid supply channel.

10. A liquid discharge device comprising the liquid discharge head according to claim 1.

11. The liquid discharge device according to claim 10, further comprising at least one of:

a head tank to store the liquid to be supplied to the liquid discharge head;

a carriage to mount the liquid discharge head;

a maintenance device to maintain the liquid discharge head; and a main scan moving device to move the carriage in a main scanning direction.

12. A liquid supply member comprising a liquid supply channel to be connected to a common liquid chamber formed in a liquid discharge head that includes a plurality of nozzles to discharge liquid, the liquid supply member including:

a first member including a part of the liquid supply channel and a first fib formed at a peripheral portion of the part of the liquid supply channel to surround the part of the liquid supply channel; and a second member including a gas chamber and a second rib formed at a peripheral portion of the gas chamber to surround the gas chamber, wherein an elastic member is disposed between the rust member and the second member, the elastic member forming a wall of the liquid supply channel of the first member and a wall of the gas chamber of the second member, the gas chamber of the second member is disposed opposite the liquid supply channel of the first member via the elastic member, and the elastic member is sandwiched and pressed between the first rib and the second rib.

13. A liquid discharge apparatus comprising:

the liquid discharge device according to claim 10; and a conveyor to convey a medium to the liquid discharge head, wherein the liquid discharge device discharges the liquid to the medium from the plurality of nozzles of the liquid discharge head.

* * * * *